United States Patent [19]

Severin

[11] 4,120,070

[45] Oct. 17, 1978

[54] CLEANING SYSTEM

[76] Inventor: Hubert J. Severin, 18 Beacon Rd., Bethany, Conn. 06525

[21] Appl. No.: 767,578

[22] Filed: Feb. 10, 1977

Related U.S. Application Data

[63] Continuation-in-part of Ser. No. 600,638, Jul. 31, 1975, abandoned.

[51] Int. Cl.[2] ..... B08B 5/02

[52] U.S. Cl. ..... 15/306 B; 15/316 R; 15/405; 15/415 R

[58] Field of Search ..... 15/306 R, 306 A, 306 B, 15/316 R, 345, 346, 405, 415 R, 415 A; 239/568; 34/160; 118/63

[56] References Cited

U.S. PATENT DOCUMENTS

| | | | |
|---|---|---|---|
| 408,235 | 8/1889 | Haskell | 239/568 X |
| 1,771,558 | 7/1930 | DeRepentigny | 15/306 A X |
| 3,462,851 | 8/1969 | Urbas et al. | 239/568 X |
| 3,568,238 | 3/1971 | Fischer et al. | 15/306 B |
| 3,690,293 | 9/1972 | Pierson | 118/63 |
| 3,849,831 | 11/1974 | DeVerter et al. | 15/306 B X |

FOREIGN PATENT DOCUMENTS

| | | | |
|---|---|---|---|
| 606,036 | 8/1948 | United Kingdom | 15/405 |

*Primary Examiner*—Christopher K. Moore

[57] ABSTRACT

A cleaning system comprises a conveyor and an air knife having a number of side-by-side, closely-adjacent slots which provide communication from an internal chamber to a forward edge. As a result, air charged into the chamber issues from the slots as a sheet in streamline flow, which is effective along sharply-defined margins of a workpiece conveyed therepast. The system is especially suited for cleaning powder from wire leads of an electrical component, without disturbing the deposit on the component body.

6 Claims, 4 Drawing Figures

CLEANING SYSTEM

CROSS REFERENCE TO RELATED APPLICATION

This application is a continuation-in-part of application Ser. No. 600,638, filed July 31, 1975 and now abandoned.

BACKGROUND OF THE INVENTION

There are a number of applications in which so-called "air knives" are used to clean workpieces, such devices having means for directing a stream of air so as to remove an unwanted deposit from a portion of a workpiece. Air knives find particular application in powder coating systems, wherein particulate materials are deposited, with or without the aid of electrostatic effects, upon the workpiece. While various masking techniques are widely used in such systems, often they are either not sufficiently effective or precise to maintain the uncoated parts as powder-free as may be necessary, or subsequent transfer of the powder from the coated to the uncoated areas causes intolerable contamination of the latter. Normally, air knives are used to clean the parts prior to conversion of the particulate material to a permanent coating.

Typically, air knives have, in the past, taken the form of a series of discrete nozzles or needles disposed at spaced locations along the travel path of a conveyed workpiece. While effective for many purposes, it has been found that separate nozzles are rather unsatisfactory for the cleaning of thin or fine parts, such as the wire leads of electrical components. The surges of air to which the part is subjected in passing from one of such nozzles to the next produces imprecise definition between the coated and uncoated areas, and causes particles to be dislodged from the areas on which a coating is necessary. Also, some difficulty is experienced in setting-up and adjusting a series of individual nozzles, and in maintaining them in proper order to produce optimum results.

Accordingly, it is an object of the present invention to provide a novel cleaning system utilizing air knife apparatus which is capable of producing a uniform sheet or stream of air, which system may be used to produce a precise margin between coated and uncoated portions of workpieces conveyed therethrough.

It is also an object of the invention to provide such a system, whch is efectively employed for cleaning thin and fine parts without causing undesirable air surge effects.

Another object is to provide such a system, which is simple and economical to construct, and facile to use and maintain.

SUMMARY OF THE DISCLOSURE

It has now been found that the foregoing and related objects of the invention are readily attained in a system comprising an air knife, and means for conveying a plurality of workpieces therepast. The air knife is comprised of a body having an outer edge portion and an internal chamber with an inlet thereinto and an outlet therefrom. The inlet is adapted to receive air under pressure from a source thereof, and the outlet is comprised of a multiplicity of side-by-side, closely-adjacent slots extending substantially from the internal chamber and opening to the outer edge portion of the body, thereby cooperatively providing a substantially continuous slit therealong. As a result, air charged under pressure into the chamber of the body may issue from the slit as a sheet in streamline flow.

The conveying means is designed to carry a plurality of workpieces in succession along a travel path, which path includes a portion extending generally parallel and closely adjacent to the slit of the air knife. It is adapted to support workpieces having relatively thin parts, with such parts (which are to be cleaned) disposed transversely of the slit of the air knife during their generally parallel movement along the travel path portion. The system includes only one such air knife at the travel path portion specified, so that the streamline flow of the sheet of air issuing from the slit of the air knife is not unduly disturbed and may impinge upon the thin parts of the workpieces, to effect cleaning thereof along well-defined margins.

Preferably, the outer edge portion of the body of the air knife, and consequently the slit therealong, are substantially rectilinear, with the slots being of substantially identical rectangular cross section and parallel to one another. Appropriately, the slit will be about 0.01 to 0.02 inch high, and the slots will be about seven to ten times as wide as the spacing between them; most desirably, the slit height will be about 0.015 inch and the slot width will be about 0.5 inch. In particularly preferred embodiments, the air knife includes a plate having, in one surface, a recess and a multiplicity of relatively shallow channels extending from the recess to an outer edge thereof.

DETAILED DESCRIPTION OF THE ILLUSTRATED EMBODIMENT

Figure 1:
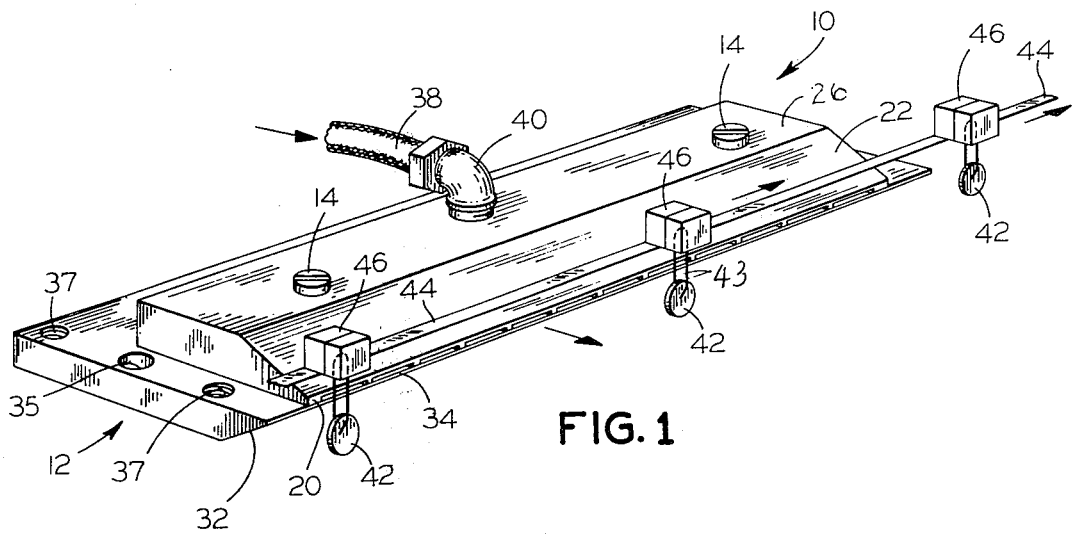
FIG. 1 is a perspctive view showing a cleaning system embodying the present invention.
Figure 2:
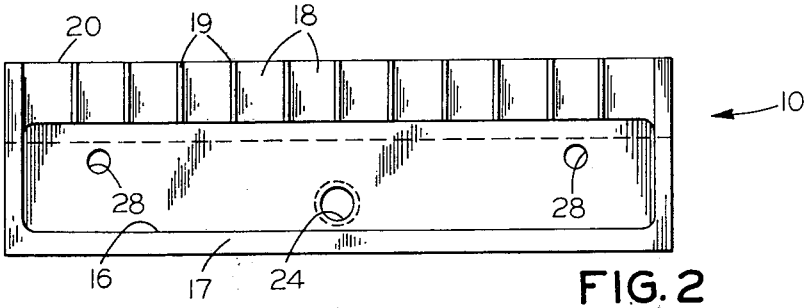
FIG. 2 is a bottom view of the upper plate of the air knife employed in the system of FIG. 1, drawn to a slightly reduced scale.
Figure 3:
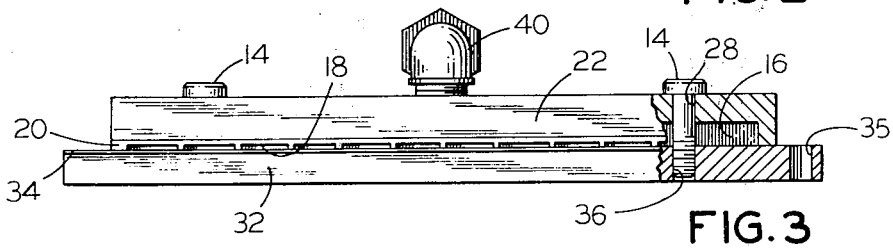
FIG. 3 is a front view of the air knife, drawn to the scale of FIG. 2 and having a corner portion broken away to show the internal construction thereof.
Figure 4:
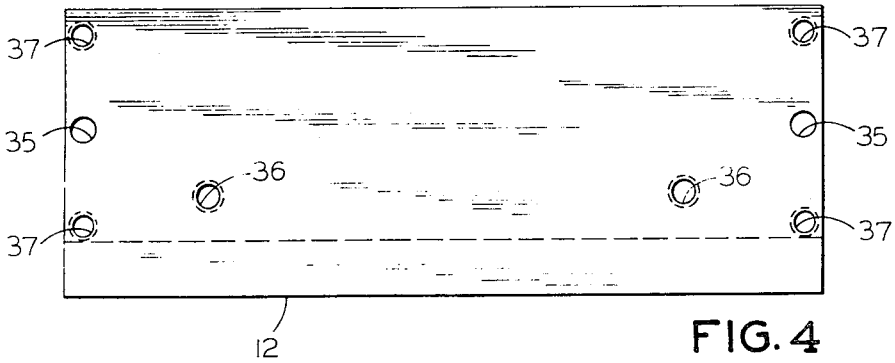
FIG. 4 is a bottom view of the lower plate employed in the air knife, drawn to the scale of FIGS. 2 and 3.

Turning now in detail to the appended drawing, therein illustrated is a cleaning system embodying the present invention, including an air knife having an upper plate generally designated by the numeral 10, and a lower plate generally designated by the numeral 12. The upper plate 10 is of rectangular configuration, and has an elongated, generally rectangular and relatively deep recess 16 formed in its lower surface 17. A multiplicity of relatively shallow, side-by-side, closely adjacent parallel channels 18 are also formed in the lower surface 17 of the upper plate 10; the channels 18 have narrow ribs 19 therebetween, and they extend outwardly from the recess 16 to the rectilinear forward edge 20 of the plate 10 where each channel ends in an elongated orifice. The plate 10 has a bevelled upper forward portion 22, and an opening 24 extending through its top surface 26 into the recess 16. Relatively small holes 28 are formed in the plate 10, and receive the screws 14 by which the plates 10,12 are joined in assembly.

The lower plate 12 is also of rectangular configuration, but is somewhat wider and longer than the plate 10, to provide outwardly extending side and rear marginal portions through which pass unthreaded holes 35 and threaded holes 37. The holes 35 receive bolts for attaching the assembly to suitable support structure (not shown), and the holes 37 receive levelling screws (also not shown). In addition, the lower plate 12 has threaded holes 36 in which the assembly screws 14 are secured, and its lower forward edge surface 32 is bevelled to a thin upper forward edge 34.

As will be appreciated, upon assembly of the lower plate 12 with the upper plate 10, the recess 16 provided in the latter will be closed, so as to constitute an internal chamber within the assembly. Similarly, the lower plate 10 will define a floor beneath the channels 18 and in contact with the bottom surfaces of the ribs 19; the channels 18 will thereby provide parallel slots of rectangular cross section extending outwardly from the internal chamber.

An air hose 38, having thereon an appropriate end coupling 40, is secured in the opening 24 of the upper plate 10 to enable air under pressure to be charged into the recess (i.e., the chamber of the assembly). Upon doing so, the air will flow from the recess 16 through each of the slots provided by the channels 18, with the separate streams which result merging slightly outwardly of the forward edges 20,34 to provide a thin sheet of air in streamline flow.

As seen in FIG. 1, a multiplicity of wire-lead electrical components 42 are supported on a fragmentarily illustrated conveyor belt 44 by the clamps 46, which are mounted thereon. In moving in the direction indicated by the arrows (i.e., to the right of the Figure), the belt 46 carries the components 42 in succession along a travel path that has a portion extending generally parallel and closely adjacent to the slit at the forward edge 34 of the air knife. The conveyor clamps 46 support the components 42 with the wire leads 43 thereof (i.e., the thin elements which are to be cleaned) generally transversely (i.e., normally vertically, with the air knife horizontally positioned) of the slit during the movement along the depicted portion of the travel path, thus enabling blow-off of a portion of the powder thereon, along well-defined margins on the leads.

It should be appreciated that division of the slit into a multiplicity of slots, such as by providing the spaced ribs 19, not only enhances structural strength and ensures consistent slit height, but also promotes uniformity of air flow rates along the entire width of the slit. These factors are, of course, important to the achievement of precision in the powder blow-off effect. While slots of rectangular cross section (in a plane normal to the air flow direction) having a width to height ratio of about 25–40:1, and preferably of about 33:1, may be easiest to fabricate and functionally most desirable, other cross sectional configurations are also feasible. Generally, the spacing between adjacent slots should be minimized (i.e., the ribs should be as narrow as possible, consistent with adequate strength), and the ratio of slot width to rib width may appropriately be about 7–10:1. In specific terms, an air knife of the construction illustrated, having a slit height of about 0.015 inch, and slot and rib widths of about 0.5 and 0.06 inch, respectively, was found to be highly effective in providing a uniform sheet of air in streamline flow.

While the apparatus of the invention may be employed in a variety of applications, it is most valuable for cleaning the wire leads of electrical components, such as capacitors, resistors, and the like. As will be understood, powder coating of such components is effected to produce electrical insulation on the body, and the coating must therefore be substantially uniform and voidfree. On the other hand, it is also necessary that the leads be substantially free from powder, to ensure that good electrical contact therewith is achieved, and it is desirable that the clean areas of the leads extend closely adjacent the body of the component. For these reasons, the high degree of margin definition attainable with the instant system, coupled with the virtual avoidance of undesirable pulsing and the achievement of uniform air flow rates which the air knife affords, makes the apparatus especially well-suited for the applications described.

Thus, it can be seen that the present invention provides a novel cleaning system utilizing an air knife which is capable of producing a uniform sheet or stream of air, which system may be used to produce a precise margin between coated and uncoated portions of workpieces, during conveyance past the air knife. The system is effectively employed for cleaning thin and fine parts, without causing undesirable air surge effects, and it is simple and economical to construct, and facile to use and maintain.

What is claimed is:

1. A system for cleaning, with air, relatively thin parts of workpieces, comprising: an air knife, comprised of a body having an outer edge portion, and an internal chamber with an inlet thereinto and an outlet therefrom, said inlet being adapted to receive air under pressure from a source thereof, and said outlet being comprised of a multiplicity of side-by-side, closely-adjacent channels extending from said chamber each channel ending in an orifice opening at said outer edge portion of said body, said orifices thereby cooperatively providing a substantially continuous slit therealong elongated in a predetermined direction, so that air charged under pressure into said chamber may issue from said slit as a sheet in streamline flow; and means for conveying a plurality of workpieces in succession along a travel path which includes a portion extending closely adjacent to said slit of said air knife and generally parallel to said predetermined direction along substantially the entire length of said slit, said conveying means being adapted to support the workpiece with thin parts thereof, which are to be cleaned, disposed generally transversely of said slit during their generally parallel movement along said travel path portion, said air knife being the only such air knife present at said travel path portion, so that the streamline flow of the sheet of air issuing from said slit of said air knife is not unduly disturbed and may impinge upon the thin parts of the workpieces to effect cleaning thereof along well-defined margins.

2. The system of claim 1 wherein said outer edge portion of said air knife body, and consequently said slit are substantially rectilinear.

3. The system of claim 1 wherein said channels of said outlet are of substantially identical rectangular cross section, and are parallel to one another.

4. The system of claim 3 wherein said slit is about 0.01 to 0.02 inch high, and wherein said channels are about seven to ten times as wide as the spacing therebetween.

5. The system of claim 4 wherein said slit is about 0.015 inch high, and wherein each of said channels is about 0.5 inch wide.

6. The system of claim 1 wherein said air knife body includes a plate having a recess in one surface, and a multiplicity of relatively shallow channel portions extending in said surface outwardly from said recess to an outer edge of said plate, said plate thereby in part defining said chamber and said channels.

* * * * *